US007285063B2

(12) United States Patent
Lussier et al.

(10) Patent No.: US 7,285,063 B2
(45) **Date of Patent: *Oct. 23, 2007**

(54) IRREGULAR HOCKEY STICK SHAFT AND A METHOD OF FABRICATION THEREOF

(75) Inventors: Remi Lussier, Drummondville (CA); Marcel Jean, Drummondville (CA); Daniel Gatien, Drummondville (CA); Germain Belanger, St-Germain-de-Grantham (CA)

(73) Assignee: 2946-6380 Quebec Inc. a/s Production P.H. Enr. (CA)

( * ) Notice: Subject to any disclaimer, the term of this patent is extended or adjusted under 35 U.S.C. 154(b) by 0 days.

This patent is subject to a terminal disclaimer.

(21) Appl. No.: 11/090,403

(22) Filed: Mar. 25, 2005

(65) Prior Publication Data

US 2005/0215364 A1 Sep. 29, 2005

(30) Foreign Application Priority Data

Mar. 26, 2004 (CA) ..... 2462333

(51) Int. Cl.
*A63B 59/14* (2006.01)

(52) U.S. Cl. ..... 473/561

(58) Field of Classification Search ..... 473/560–563
See application file for complete search history.

(56) References Cited

U.S. PATENT DOCUMENTS

| | | | | |
|---|---|---|---|---|
| 5,439,215 | A | 8/1995 | Ratchford | |
| 5,577,725 | A * | 11/1996 | Pagotto et al. | 473/560 |
| 5,718,647 | A * | 2/1998 | Tiitola | 473/562 |
| 5,816,961 | A * | 10/1998 | Kraemer | 473/560 |
| 5,879,250 | A | 3/1999 | Tahtinen et al. | |
| 5,967,913 | A | 10/1999 | Sulenta | |
| 6,241,633 | B1 * | 6/2001 | Conroy | 473/561 |
| 6,257,997 | B1 | 7/2001 | Doble et al. | |
| 6,267,697 | B1 | 7/2001 | Sulenta | |
| 6,361,451 | B1 | 3/2002 | Masters et al. | |
| 6,500,079 | B1 | 12/2002 | Tucker, Sr. | |
| 6,939,257 | B2 | 9/2005 | Tiitola | |
| 2003/0100390 | A1 | 5/2003 | Bellefleur et al. | |
| 2004/0214007 | A1 | 10/2004 | Brown et al. | |

FOREIGN PATENT DOCUMENTS

| | | |
|---|---|---|
| CA | 2106178 | 3/1995 |
| JP | 03193070 A | 8/1991 |
| WO | WO99/20357 | 4/1999 |

* cited by examiner

*Primary Examiner*—Mark S Graham
(74) *Attorney, Agent, or Firm*—Akerman Senterfitt

(57) ABSTRACT

The invention relates to hockey stick shafts having cross-section and properties varying along a length thereof and to a method for fabrication thereof. The varying cross section defines selected regions of optimized grip for the hands of a player and of optimized rigidity and resistance in torsion of the shaft.

17 Claims, 2 Drawing Sheets

IRREGULAR HOCKEY STICK SHAFT AND A METHOD OF FABRICATION THEREOF

CROSS REFERENCE TO RELATED APPLICATIONS

This application and claims priority on a Canadian patent application no. 2,462,333, filed on Mar. 26, 2004. All documents above are herein incorporated by reference.

FIELD OF THE INVENTION

The present invention relates to hockey sticks or like-game sticks. More specifically, the present invention is concerned with hockey stick shafts having a cross-section and properties varying along a length thereof.

BACKGROUND OF THE INVENTION

The art offers a variety of hockey sticks. Typically, hockey sticks comprise a shaft and a blade. The cross section of the shaft is traditionally rectangular so as to prevent undesired rotation of the shaft in the hands of a player. The cross-sectional dimensions of the hockey stick shaft are usually fixed within a narrow range by the requirement that the player must have a good grip on the shaft.

It is a common practice to make the shaft with a constant rectangular geometry from a first extremity thereof to a second extremity thereof, with a height and a width yielding an ergonomic perimeter standardly comprised between 90 and 95 mm. The rectangular shape of the shaft allows assembling either a left or a right blade, and, as mentioned hereinabove, allows a resistance to a rotation of the stick in the hands of the player, in direct relation to a pressure exerted by the hand of the player.

The shear gripping force of the hands allows the player to control the stick in a number of shots, such as the slap shop, the snap shot and the wrist shop. Such shots require a controlled rotation of the stick, and are therefore dependent on the quality of grip of the gloved hand on the stick. The wrist shop for example requires a maximum grip on the shaft for an enhanced precision. The snap shot is performed very rapidly and also requires a perfect control of the grip on the shaft of the stick through a movement of the wrists in order to generate energy of speed and a satisfactory precision. The slap shot requires the stick to be rigid, both in flexion and in torsion.

It has been shown that, when performing a slap shot, first energy is built up in the stick during a contact between the blade and the ice or the ground, before the blade hits the puck, due to a flexion of the shaft. Then the energy is released and transferred to the puck upon contacting the blade. The puck in turn, when contacting the blade, creates a torsion of the shaft, which resistance to deformation in torsion must be high in order to propel the puck at a high speed.

U.S. Pat. No. 6,267,697 and U.S. Pat. No. 5,967,913 to Sulenta describe a hockey stick with a shaft having at least a portion with a triangular cross section in an attempt to yield an adjustable grip. Canadian patent number 2,106,178 to Scherz teaches a hockey stick shaft with a handle part having at least a bottom surface thereof that is V-shaped to provide a better grip. However, it is found that although such cross sections indeed yield a better grip on the shaft by a naked hand, it is not optimized for a grip with a gloved hand at a constant gripping force.

Therefore, in spite of previous efforts, there seems to be some room for improvement in the art for a new hockey stick shaft combining an optimized grip and a high rigidity in flexion and in torsion.

SUMMARY OF THE INVENTION

There is provided a hockey stick shaft having a proximate end portion, a central portion and a tapering distal end portion with a blade mounting part, wherein at least one face of the shaft has at least one polygon cross section over at least part of a length thereof.

There is further provided a method for fabricating a hockey stick shaft having a proximate end portion, a central portion and a tapering distal end portion with a blade mounting part, comprising the step of providing at least one face of the shaft with at least one polygon cross section over at least part of a length thereof.

Other objects, advantages and features of the present invention will become more apparent upon reading of the following non-restrictive description of embodiments thereof, given by way of example only with reference to the accompanying drawings.

DESCRIPTION OF EMBODIMENTS

Generally stated, there is provided a hockey stick shaft having varying cross-section and properties along a length thereof, from a proximate end portion to a tapering distal end portion thereof.

Figure 1:
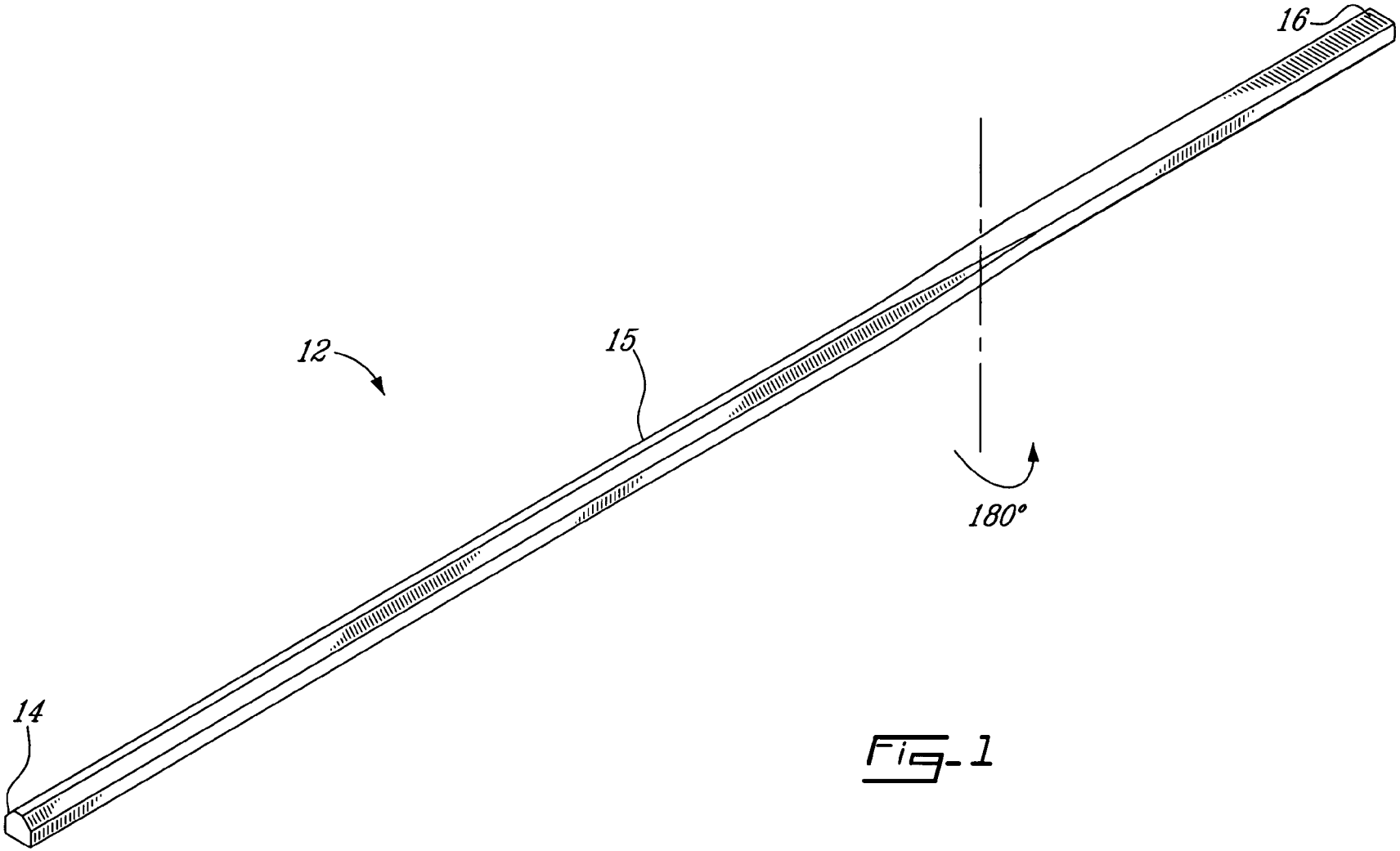
FIG. 1 is a perspective view of a hockey stick shaft according to a first embodiment of the present invention.

As illustrated in the FIG. 1 of the appended drawings, a hockey stick generally comprises a longitudinal shaft 12 provided with a proximate end portion 14, a central portion 15, a tapering distal end portion 16, and a blade (not shown) mounted to the distal end portion 16.

The present invention is mainly concerned with the longitudinal shaft 12, so that the other parts of the stick will not be described in detail herein, since they are believed well known to people skilled in the art.

Each parts of the hockey stick have different functions and are submitted to specific applied forces, and that the hands of the player are not located on a same edge of the shaft simultaneously. For example, the proximate end portion 14 provides for a grip by a first hand of a player and the central portion 15 generally provides a grip for a second hand of the player. The portion comprised between the two hands of the player acts as a spring that stocks and releases energy. The grip on the shaft may also depend in part on the gloves the player wears. Gloves are usually made of a relatively stiff material such as leather, and, when the gloved hands grip the shaft, the glove form creases due to a thickness thereof. Moreover, depending of the wetness of the material they are made of, their slippering characteristics vary.

Various embodiments of the shaft of the present invention will now be described.

In FIG. 1, the shaft 12 is an elongated member with a cross section in the proximate end portion 14 and in the central portion 15 being a symmetric or asymmetric polygon, with 6 faces for example, the circumference all over the length of the shaft 12, from the proximate end portion 14 up to the distal end portion 16, which has a rectangular cross section for mounting the blade (not shown), being constant and similar to the standard circumference of rectangular cross section hockey shafts known in the art.

The polygon cross section provides an increased number of edges along the length of the shaft, which is found to yield an enhanced grip thereon by gloved hands.

Moreover, as shown in FIGS. 2 to 5, the polygon cross-section may be varied along the length of the shaft, depending on the requirement of the different parts thereof as described hereinabove.

Figure 2:
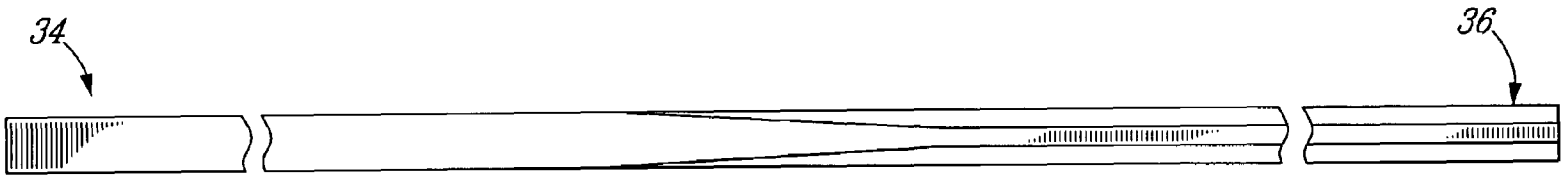
FIG. 2 is a front view of a hockey stick shaft according to an embodiment of the present invention.
Figure 3:
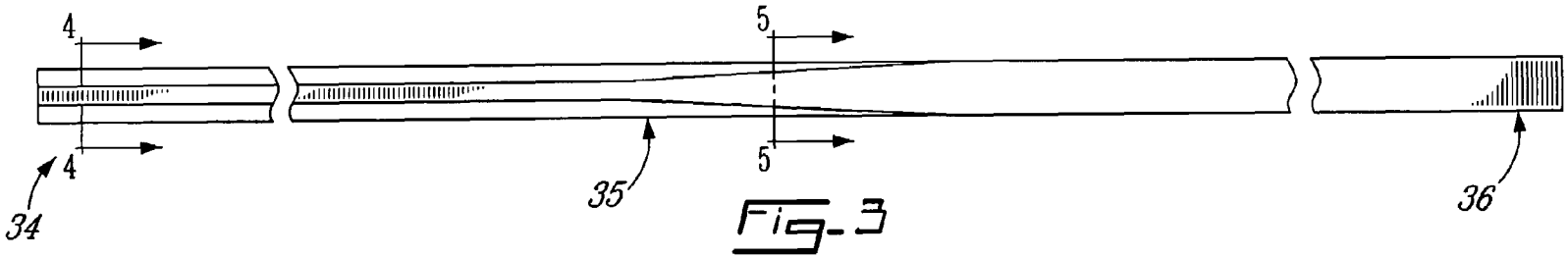
FIG. 3 is a back view of the hockey stick shaft of FIG. 2.

FIG. 2 shows a front surface of a shaft according to an embodiment of the present invention, and FIG. 3 shows its back surface.

Figure 5:
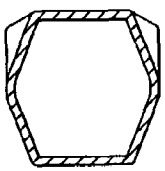
FIG. 5 is a cross section of the hockey stick shaft of FIGS. 2 and 3.
Figure 4:
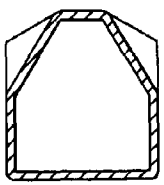
FIG. 4 is a cross section of the hockey stick shaft of FIGS. 2 and 3.

In the back surface shown in FIG. 3, the proximate end portion 34 has a first polygon cross section, shown in FIG. 5, and a region between the central portion 35 and the distal end portion 35 has a second cross section rotated by 180 degrees in relation to the first cross section as shown in FIG. 5. People in the art will appreciate that such an inversion allows for the inverted position of the hands of the player.

Although in FIG. 2, the front surface is symmetrical to the back surface of FIG. 3, it may be contemplated providing asymmetric front and back surfaces.

The cross section may be linearly inverted from a front face to a back face of the shaft, along the length thereof, in order to increase mechanical resistance in torsion and flexion, as shown in FIGS. 2 and 3.

Figure 6:
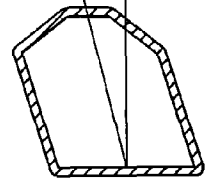
FIG. 6 is a cross section of a hockey stick shaft according to another embodiment of the present invention.
Figure 7:
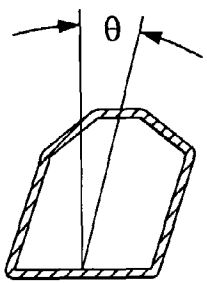
FIG. 7 is a cross section of a hockey stick shaft according to a further embodiment of the present invention.

As further illustrated in FIGS. 6 and 7, the polygonal cross section may be selected as having a left or a right orientation.

It is found that the polygon cross section yields a surface moment of inertia superior to that achieved by a rectangular cross section of a same circumference for a given thickness of the walls of the shaft. In FIGS. 4 to 7, the thickness of the walls is the distance between the inner and outer periphery of the hollow shaft. The polygon cross section consequently causes an increased localized stiffness of the shaft, while maintaining the weight and circumference of the shaft.

The polygon cross section may be provided on target parts of the length of the shaft. A polygon cross section in the first half part of the shaft from the proximate end portion is for example inverted by 180 degrees in the second half part thereof, providing a cross-over region, extending over a varying length of the shaft, of increased moment of inertia and therefore of increased stiffness, in the intermediate region of the shaft.

Therefore, according to a second aspect of the present invention, there is provided a method for fabricating a hockey stick shaft comprising the step of providing at least one face of the shaft with at least one polygon cross section over at least part of a length thereof.

It is further contemplated providing high tensile strength wires on at least longitudinal parts of at least one plane surface of the shafts 12 longitudinally oriented inside a thickness of the walls thereof in cases of hollow shafts for example, as a way to increase a toughness in flexion (higher rigidity) thereof at a relatively constant weight.

When wires are provided on the shaft in opposite surfaces, which are submitted to tension and compression forces generated by the flexion of the shaft, they provide a reinforcing system able to limit an amplitude of deformation of the shaft. Due to a high tensile strength and to a high modulus of elasticity thereof, the wires therefore make the shaft tougher and even more resistant in flexion, with a minimized increase of weight.

The wires are typically metallic (including non-ferrous) wires, and made in aluminum, brass or steel for example, as required by performance and process criteria including the weight of the shaft, and the way the wires are provided into the material of the shaft, for example. The wires may further be in organic or inorganic material. Alternatively, organic or inorganic fibers, in the form of integral molded rovings or of premolded cables added during molding, may be provided on at least longitudinal parts of at least one plane surface of the shafts 12 longitudinally oriented inside a thickness of the walls of the hollow shaft, as a way to increase a toughness in flexion (higher rigidity) thereof at a relatively constant weight.

In the case of a laminated composite shaft, an optimized quality of bonding between the wires and a resin matrix of the laminated composite may be achieved by using brass electroplated steel wires, twisted wires or a wire mesh for example. The wires may be encapsulated, embedded or mechanically incorporated into the material of the selected surface(s) of the shaft.

It is to be noted that wires extending along the length of the shaft may further hold broken pieces of the shaft together in the event of a transverse sectional breakage thereof for example. Since they are encapsulated, embedded or mechanically incorporated into the material of at least one surface of the shaft and due to their high tensile strength, the wires indeed maintain a structural integrity even upon total breakage of the section of shaft, thereby preventing the broken pieces, which generally have cutting edges, to be separated apart. Thus, risks of injuries due to exposed cutting edges of the broken pieces are reduced.

The shafts of the present invention may be a hollow laminated or a hollow wood shaft for example.

People in the art will appreciate that the hockey stick shafts according to the present invention meet standard requirements of the art, including an ergonomic circumference, rigidity, weight, and adequate position of a center of gravity thereof.

Moreover, the hockey stick shafts according to the present invention allow an optimized quality of the grip by the gloved hands of the player, for example by providing an increased resistance to slipping during a rotational movement of the gloved hand of the player about the shafts, as well as an increased rigidity and enhanced safety features if desired.

Although the present invention has been described hereinabove by way of embodiments thereof, it can be modified, without departing from the nature and teachings thereof as described herein.

What is claimed is:

1. A hockey stick shaft having at least two regions along a length thereof of non-rectangular polygon cross sections that are linearly inverted by 180 degrees from a front face to a back face of the shaft, along the length thereof, one relative to the other, wherein the cross section is varied along a length of at least one of said faces with a constant circumference and thickness of walls of the shaft all along the length thereof.

2. The hockey stick shaft as recited in claim 1, wherein the cross sections are one of i): symmetric polygon cross sections and ii) asymmetric polygon cross sections.

3. The hockey stick shaft as recited in claim 1, wherein at least one region has a polygon cross section with one of a left and a right orientation.

4. The hockey stick shaft as recited in claim 1, wherein at least one region has an irregular cross section.

5. The hockey stick shaft as recited in claim 1, wherein at least one region has a cross section that is linearly inverted from a front face to a back face of the shaft.

6. The hockey stick shaft as recited in claim 1, said shaft having a proximate end portion, a central portion and a tapering distal end portion with a blade mounting part, said proximate end portion having a first polygon cross section, and a region between said central portion and said distal end portion having a second cross section rotated by 180 degrees in relation to the first cross section.

7. The hockey stick shaft as recited in claim 1, further comprising reinforcements selected in the group consisting of longitudinally oriented high tensile strength wires and fibers, on at least one part of at least one plane surface thereof.

8. The hockey stick shaft as recited in claim 7, said reinforcements being provided in opposite surfaces of the shaft.

9. A method for fabricating a hockey stick shaft comprising the step of providing at least two regions along a first and a second lengths thereof with non-rectangular polygon cross sections that are linearly inverted by 180 degrees from a front face to a back face of the shaft, along the length thereof, one relative to the other, wherein the cross section is varied along a length of at least one of said faces, according to specific forces applied on the at least two regions, with a constant circumference and thickness of walls of the shaft all along the length thereof.

10. The method according to claim 9, comprising providing at least one face of the shaft with a first polygon cross section over at least part of a proximate end portion and a central portion thereof.

11. The method according to claim 9, comprising the step of varying a cross section along a length of the at least one face.

12. The method according to claim 9, comprising the step of linearly inverting at least one cross-section from a front face to a back face of the shaft.

13. The method according to claim 10, comprising providing at least one face of the shaft in the proximate end portion and in the central portion with a first polygon cross section over at least part of a length thereof and a second cross section rotated by 180 degrees in relation to the first cross section in the proximate end portion.

14. The method according to claim 9, further comprising the step of inserting reinforcements selected in the group consisting of longitudinally oriented high tensile strength wires and fibers, on at least parts of walls of at least one face thereof.

15. The method according to claim 9, further comprising the step of inserting reinforcements selected in the group consisting of longitudinally oriented high tensile strength wires and fibers, on at least parts of walls of opposite faces of the shaft.

16. The hockey stick shaft as recited in claim 1, comprising a first polygon cross section in a first half part of the length of the shaft from a proximate end portion thereof, and a second polygon cross section in a second half part of the length of the shaft from the proximate end portion thereof, said second polygon cross section being inverted by 180 degrees relative to said first polygon cross section, providing a cross-over region, between said first and second polygon cross sections, of increased moment of inertia and increased stiffness.

17. The method according to claim 9, wherein said step of providing at least two regions comprises providing a first polygon cross section in a first half part of the length of the shaft from a proximate end portion, and providing a second polygon cross section inverted by 180 degrees relative to the first polygon cross section in a second half part of the length of the shaft from the proximate end portion, thereby providing a cross-over region, between the first and second polygon cross sections, of increased moment of inertia and increased stiffness.

* * * * *